US008773319B1

(12) United States Patent
Anderson et al.

(10) Patent No.: US 8,773,319 B1
(45) Date of Patent: Jul. 8, 2014

(54) CONFORMAL LENS-REFLECTOR ANTENNA SYSTEM

(75) Inventors: Trevis D. Anderson, Salt Lake City, UT (US); Heather M. Harrison, Salt Lake City, UT (US); Brian M. Wynn, Salt Lake City, UT (US); Douglas H. Ulmer, Salt Lake City, UT (US)

(73) Assignee: L-3 Communications Corp., New York, NY (US)

( * ) Notice: Subject to any disclaimer, the term of this patent is extended or adjusted under 35 U.S.C. 154(b) by 381 days.

(21) Appl. No.: 13/361,026

(22) Filed: Jan. 30, 2012

(51) Int. Cl.
*H01Q 19/10* (2006.01)

(52) U.S. Cl.
USPC ..... 343/755; 343/832; 343/762; 343/705

(58) Field of Classification Search
None
See application file for complete search history.

(56) References Cited

U.S. PATENT DOCUMENTS

| | | | | |
|---|---|---|---|---|
| 2,921,309 | A | 10/1954 | Elliott | |
| 4,380,014 | A * | 4/1983 | Howard | 343/786 |
| 4,963,878 | A * | 10/1990 | Kildal | 343/781 P |
| 5,606,334 | A * | 2/1997 | Amarillas et al. | 343/840 |
| 5,654,724 | A | 8/1997 | Chu | |
| 5,706,015 | A | 1/1998 | Chen et al. | |
| 5,748,190 | A * | 5/1998 | Kjorsvik | 715/867 |
| 5,859,618 | A * | 1/1999 | Miller et al. | 343/725 |
| 5,973,654 | A * | 10/1999 | Lusignan et al. | 343/786 |
| 6,087,999 | A | 7/2000 | Muhlhauser et al. | |
| 6,219,004 | B1 | 4/2001 | Johnson | |
| 6,603,432 | B2 | 8/2003 | Hill et al. | |
| 6,844,862 | B1 * | 1/2005 | Cencich et al. | 343/832 |
| 7,046,199 | B2 | 5/2006 | Montgomery et al. | |
| 7,548,190 | B2 * | 6/2009 | Baldi | 342/175 |
| 2006/0220974 | A1 * | 10/2006 | Sakakibara et al. | 343/772 |
| 2006/0244669 | A1 | 11/2006 | Mansour et al. | |
| 2010/0097277 | A1 * | 4/2010 | Lee et al. | 343/708 |

OTHER PUBLICATIONS

Nakano et al., "Extremely Wide-band, Low-profile BOR-SPR Antenna," Proceedings of iWAT2008, Chiba, Japan, IEEE (2008) pp. 20-23.

Qin, "Dielectric Lens Antenna With Scan Reflector," IEEE Transactions on Aerospace and Electronic Systems, vol. 33, No. 1 (Jan. 1997), pp. 98-101.

Tsugawa et al., "Experimental Study of Dielectric Loaded Planar Antenna Fed by Waveguide Network," Dept. of Electronic Engineering, Osaka Institute of Technology and the Kansai Electronics Industry Development Center, IEEE (1994), pp. 480-483.

* cited by examiner

*Primary Examiner* — Trinh Dinh
(74) *Attorney, Agent, or Firm* — Kirton McConkie

(57) ABSTRACT

A conformal lens-reflector antenna system in which a radio frequency (RF) reflector is disposed in a depression in a raised portion of a dielectrical RF lens. The RF reflector can be shaped to reflect RF signals between an RF feed path to the lens and a body of the lens that extends generally laterally away from the raised portion. RF signals having a frequency within a resonant frequency range of the lens can be directed along the RF feed path to the reflector, which can reflect the RF signals into the body of the lens from which the RF signals can radiate. Similarly, RF signals in the resonant frequency range of the lens in space near the lens can resonate in the lens, and the reflector can reflect those signals down the RF feed path.

28 Claims, 7 Drawing Sheets

CONFORMAL LENS-REFLECTOR ANTENNA SYSTEM

BACKGROUND

A conformal antenna is an antenna that generally conforms to a surface of a structure to which the antenna is mounted. Such antennas have been used on, for example, aircraft. For example, conformal antennas have been mounted to an outer surface of an aircraft. Because such an antenna generally conforms to the outer surface of the aircraft, conformal antennas can be more aerodynamic, and thus create less drag, than other types of antennas. The present invention is directed to a conformal lens-reflector antenna system that provides several advantages over prior art antennas.

SUMMARY

In some embodiments of the invention, a radio frequency (RF) antenna system can include an RF lens, which can comprise a raised portion and a body that extends laterally from the raised portion. The antenna system can also include an RF reflector, which can be disposed in a depression in the raised portion of the lens. The RF reflector can be shaped to reflect an RF signal between the body of the lens and an RF feed path to the raised portion of the lens. The RF feed path can be generally parallel to an axis that passes through the depression in the raised portion of the lens.

In some embodiments of the invention, a process can broadcast RF signals from a lens-reflector antenna system. The process can include directing an RF signal towards a depression in a raised portion of an RF lens. An RF reflector can be disposed in a depression in the lens and can reflect the RF signal into a body of the lens. The body of the lens can extend laterally from the raised portion of the lens. The RF signal can then radiate from the body and raised portion of the lens.

DETAILED DESCRIPTION OF EXEMPLARY EMBODIMENTS

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, as the terms "on," "attached to," or "coupled to" are used herein, one object (e.g., a material, a layer, a substrate, etc.) can be "on," "attached to," or "coupled to" another object regardless of whether the one object is directly on, attached, or coupled to the other object or there are one or more intervening objects between the one object and the other object. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

Embodiments of the invention include a conformal antenna system in which an electrically conductive radio frequency (RF) reflector is disposed in a depression in a raised portion of a dielectrical RF lens, which can be a dielectric resonator. The RF reflector can be shaped to reflect RF signals between an RF feed path to the lens and a body of the lens that extends generally laterally away from the raised portion. RF signals having a frequency within a resonant frequency range of the lens can be directed (e.g., from a transmitter device) along the RF feed path to the reflector, which can reflect the RF signals into the body of the lens from which the RF signals can radiate. Similarly, RF signals in the resonant frequency range of the lens in space near the lens can resonate in the lens, and the reflector can reflect those signals down the RF feed path (e.g., to a receiver device). An example is illustrated in FIGS. 1A-1C, which illustrates an example of a conformal antenna system 100 comprising a dielectric RF lens 104, an electrically conductive RF reflector 116, and an RF feed path 120 to the lens 104 according to some embodiments of the invention.

Figure 1A:
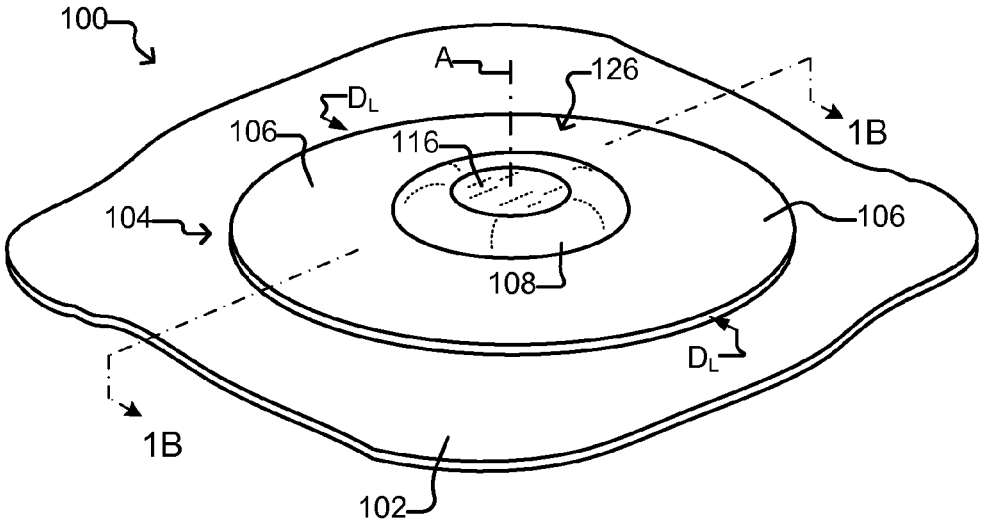
FIG. 1A is a perspective view of a conformal lens-reflector antenna system according to some embodiments of the invention.
Figure 1B:
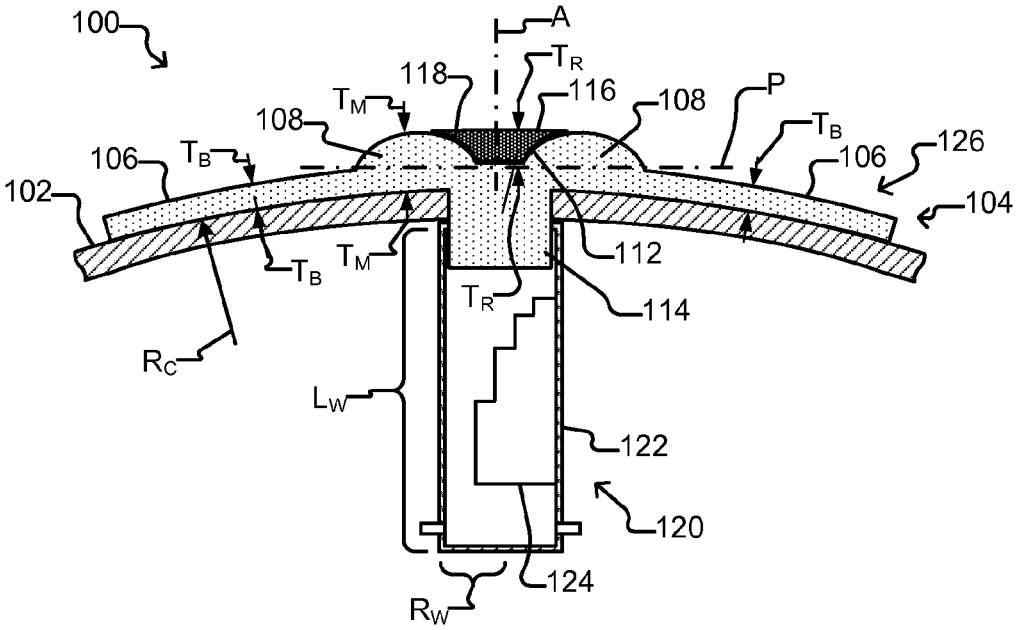
FIG. 1B is a side, cross-sectional view of the antenna system of FIG. 1A.
Figure 1C:
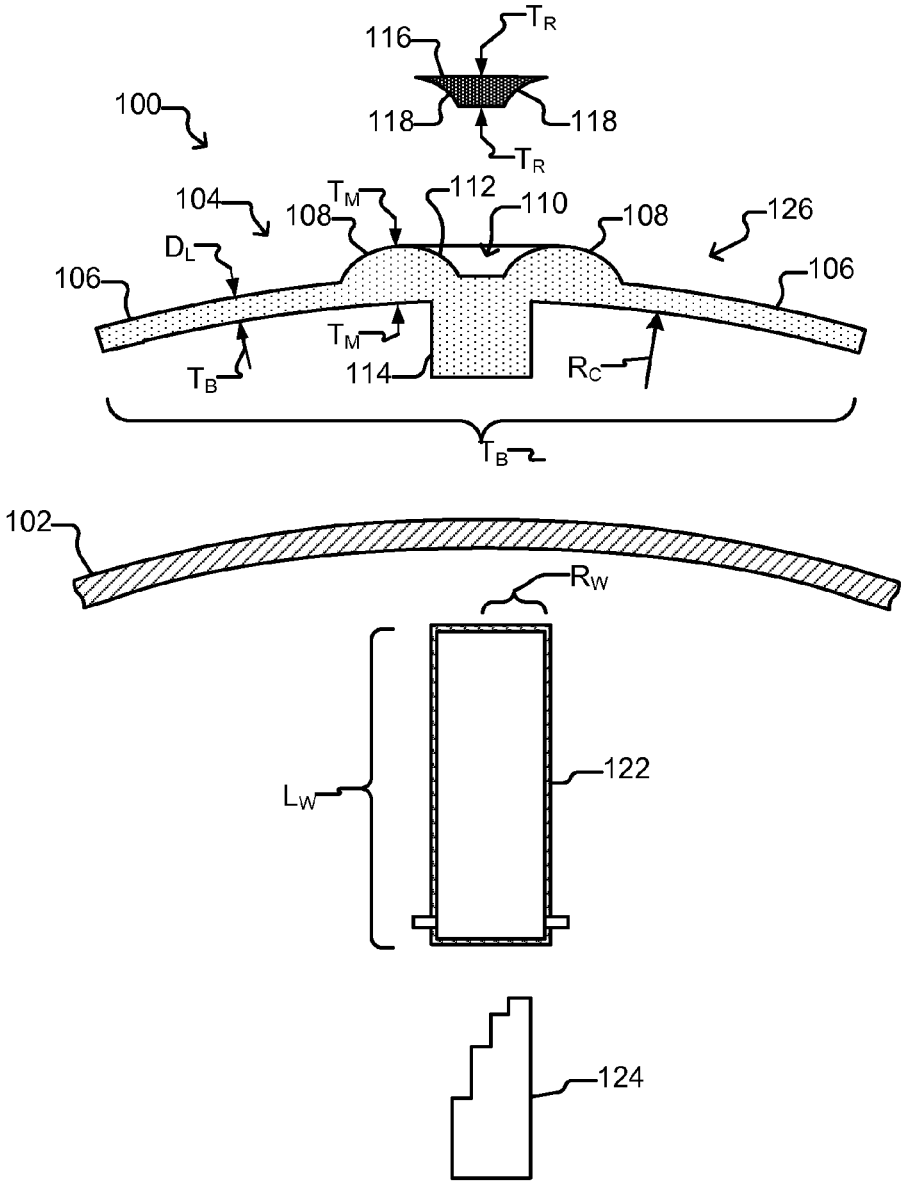
FIG. 1C is an exploded version of the view of FIG. 1B.

As shown in FIGS. 1A-1C, the dielectric RF lens 104 can comprise a raised portion 108 (e.g., a protrusion) and a body 106, which can extend away from the raised portion 108. There can be a depression 110 (see FIG. 1C) in the raised portion 108 (e.g., in approximately the center of the raised portion 108), which can provide a seat 112 for the reflector 116. The depression 110 can be sized and shaped to fit the reflector 116. In some embodiments, the raised portion 108 can be located approximately in the center of the lens 104, and the body 106 can extend laterally from the raised portion 108.

As the name implies, the dielectric lens 104 can comprise one or more dielectric materials. In some embodiments, the dielectric lens 104 can have a dielectric constant between 1 and 12. For example, the dielectric constant of the lens 104 can be between 2 and 4. In other embodiments, however, the dielectric constant can be greater than 12. Moreover, the dielectric lens 104 can comprise material(s) that are readily shaped (e.g., by machining) and are sufficiently flexible to expand or contract in response to changes in ambient temperature, mechanical vibrations, or the like. Other desirable characteristics of material(s) for the dielectric lens 104, in some embodiments, include relatively low permittivity and relatively high power handling capability. One suitable dielectric material is polytetrafluoroethylene, which is marketed by the Dupont Corporation as Teflon®. Polytetrafluoroethylene is but an example, however, and the dielectric lens 104 can comprise other dielectric materials.

The lens 104 can be attached to a support structure 102. For example, the lens 104 can be adhered, bolted, clamped, riveted, or otherwise attached to the support structure 102. The support structure 102 can be electrically conductive and can, among other things, function as a ground plane for the antenna system 100. The support structure 102 can thus be connected to electrical ground or a voltage that is the equivalent of ground. The structure 102 need not, however, be planar but can be curved (as illustrated in FIGS. 1B and 1C), angled, or otherwise non-planar. As shown in FIG. 1B, the lens 104 can be shaped to conform generally to the shape of the support structure 102. The lens 104 can thus extend a minimal distance from the surface of the support structure 102.

The reflector 116 can be electrically conductive and can thus comprise an electrically conductive material or materials. For example, the reflector can comprise an electrically conductive metal such as aluminum, copper, or the like or a combination of such metals or alloys that include such metals. As noted, the reflector 116 can be disposed in the depression 110 in the raised portion 108 of the lens 104. For example, depression 110 can form a seat 112 on which the reflector 116 can be disposed. As shown in FIGS. 1B and 1C, the reflector 116 can comprise one or more surfaces 118 shaped and positioned to reflect RF signals between the body 106 of the lens 104 and the RF feed path 120. The reflector 116 can be held in position in the depression 110 in any suitable fashion. For example, the reflector 116 can be adhered, bolted, clamped, riveted, or otherwise attached to the seat 112. As another example, the reflector 116 can be friction fit into the depression 110.

The RF feed path 120 can be a path for RF signals to and from the reflector 116. As illustrated in FIGS. 1B and 1C, the RF feed path 120 can comprise a waveguide 122 in some embodiments. The waveguide 122 can, for example, be connected to a source (not shown) of RF signals such as an RF transmitter (not shown), which can provide RF signals through the waveguide 122 to the reflector 116. The waveguide 122 can also be connected to a sink (not shown) of RF signals such as an RF receiver (not shown), which can receive RF signals reflected by the reflector 116 into the waveguide 122. The waveguide 122 can be circular, square, rectangular, or the like or a combination of the foregoing. Moreover, the waveguide 122 can include corrugations (not shown) or other such internal features (not shown). For example, as shown in FIGS. 1B and 1C, the waveguide 122 can include a polarizer 124. In some embodiments, the polarizer 124 can be a circular polarizer (e.g., a septum polarizer) that circularly (right or left handed) polarizes an RF signal in the waveguide 122. The waveguide 122 can also be dielectrically loaded. For example, the lens 104 can comprise a base 114 that extends into the waveguide 122.

As shown in FIGS. 1A and 1B, the RF feed path 120 can be along or generally parallel to an axis A that passes through the depression 110, and thus the reflector 116, in the raised portion 108 of the lens 104. As also shown in FIG. 1B, the body 106 of the lens 104 can extend laterally from the raised portion 108 initially in a plane P that is generally perpendicular to the axis A. As discussed above, the body 106 of the lens 104 can be curved or otherwise shaped to conform to the surface of the support structure 102. Thus, the body 106 can diverge away from the plane P as needed to conform to the surface of the support structure 102. In some embodiments in which the surface of the support structure 102 is curved as illustrated in FIG. 1B, the body 106 can curve away from the plane P as shown in FIG. 1B.

As noted, the lens 104, reflector 116, and RF feed path 120 can be part of an antenna system 100. As such, the dielectric lens 104 can be configured to be a dielectric resonator and thus function as an antenna. The dielectric constant and size dimensions of the lens 104 can be selected such that RF signals having a particular frequency (hereinafter the "resonant frequency") resonate in the lens 104. Of course, as a practical matter, RF signals having a frequency in a range of frequencies (hereinafter the "resonant frequency range") around the resonant frequency will also resonate in the lens 104. Thus, RF signals in the resonant frequency range can resonate in the lens 104 and thereby radiate from the lens 104 into space (e.g., ambient air). Similarly, RF signals in the resonant frequency range that are in space (e.g., ambient air) around the lens 104 can resonate in the lens 104. The lens 104 can thus function as both a transmitting and receiving antenna for RF signals in the resonant frequency range.

Figure 2:
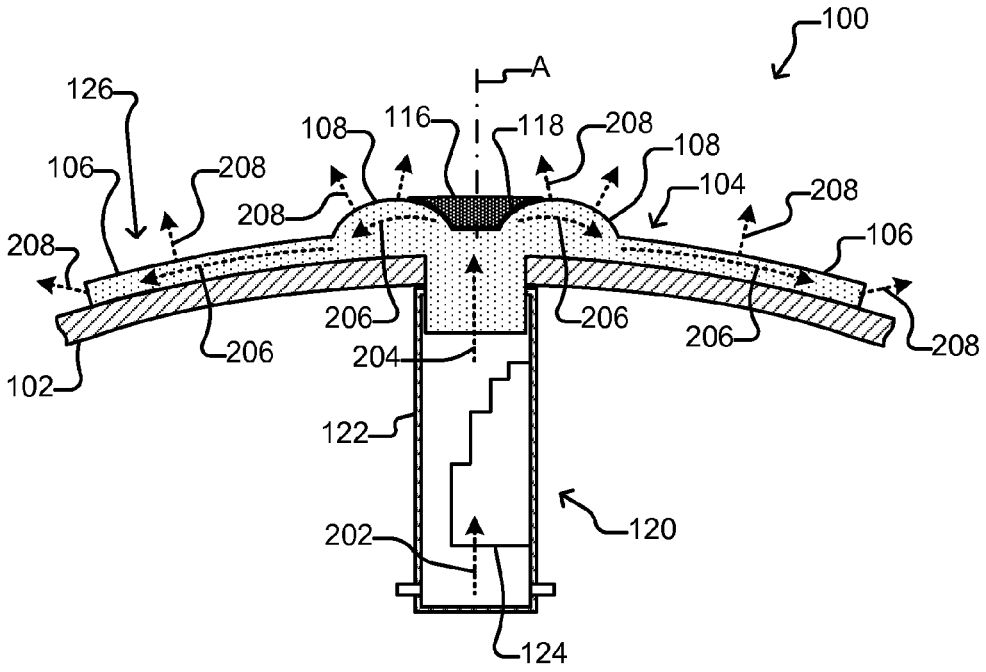
FIG. 2 illustrates an example of radiation of an RF signal by the antenna system of FIGS. 1A-1C according to some embodiments of the invention.

FIG. 2 illustrates an example of operation of the antenna system 100 in which an RF signal is transmitted from the antenna system 100. The RF signal can be any kind of RF signal including a communications RF signal or a radar RF signal. In the example of FIG. 2, an RF signal 202 is directed along the RF feed path 120 generally along or in parallel with the axis A toward the reflector 116. The frequency of the RF signal 202 can be in the resonant frequency of the lens 104. As noted, the RF feed path 120 can comprise a waveguide 122, and the RF signal 202 can thus travel through the waveguide 122 toward the reflector 116 as shown in FIG. 2. The RF signal 202 can be polarized by the polarizer 124 in the waveguide 122. A polarized RF signal 204 can thus exit the waveguide 122 and impinge the reflector 116. In some embodiments, the polarizer 124 can be a circular polarizer and the polarized RF signal 204 can be circularly (left or right handed) polarized. In other embodiments, however, the polarizer 124 can be other than a circular polarizer.

As discussed above, the reflector 116 can reflect the polarized RF signal 204 from the RF feed path 120 into the body 106 of the lens 104. The reflected RF signal is labeled with reference number 206 in FIG. 2. As noted above, the frequency of the RF signal can be in the resonant frequency range of the lens 104. The reflected RF signal 206 in the lens 104 can thus resonate in the lens 104, which can result in the RF signal radiating from the raised portion 108 and the body 106 of the lens 104. The RF signal radiating from the lens 104 is labeled with reference number 208 in FIG. 2.

Figure 3A:
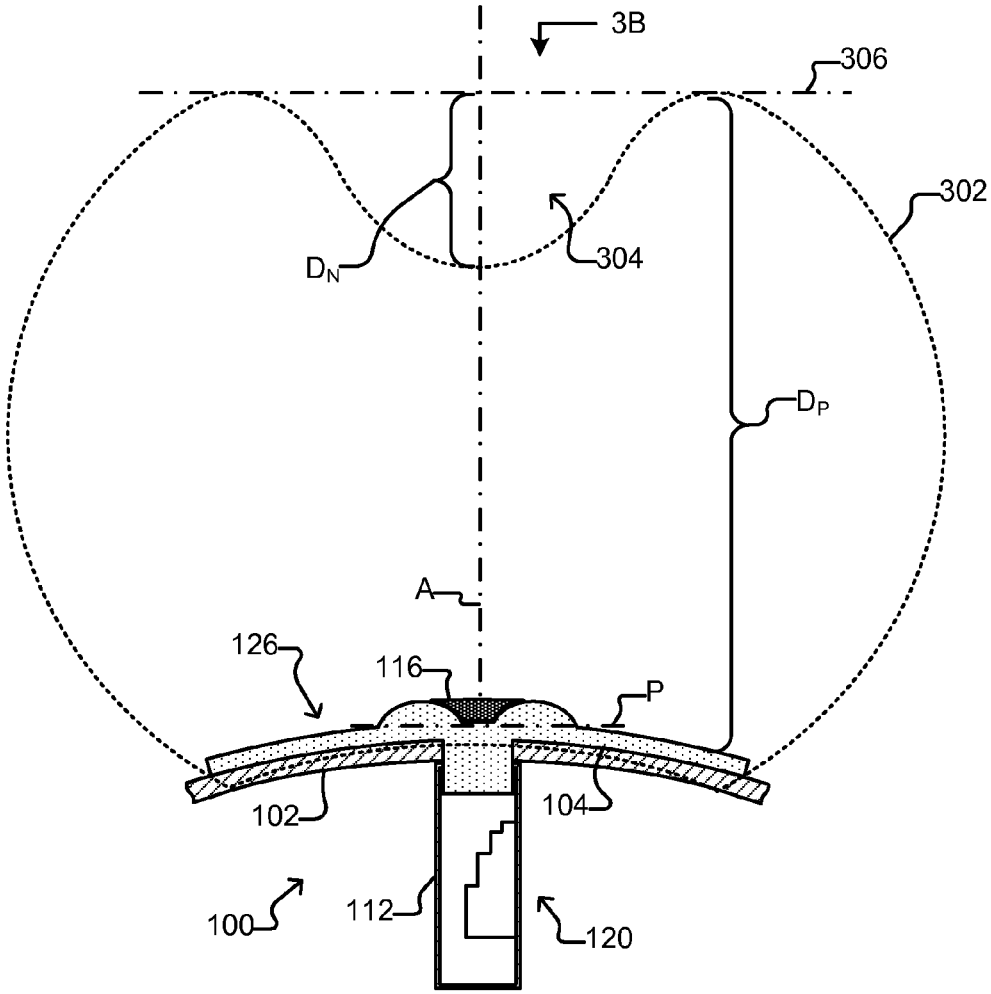
FIG. 3A shows a side view and FIG. 3B shows a top view of an example of a radiation pattern from the antenna system of FIGS. 1A-1C according to some embodiments of the invention.
Figure 3B:
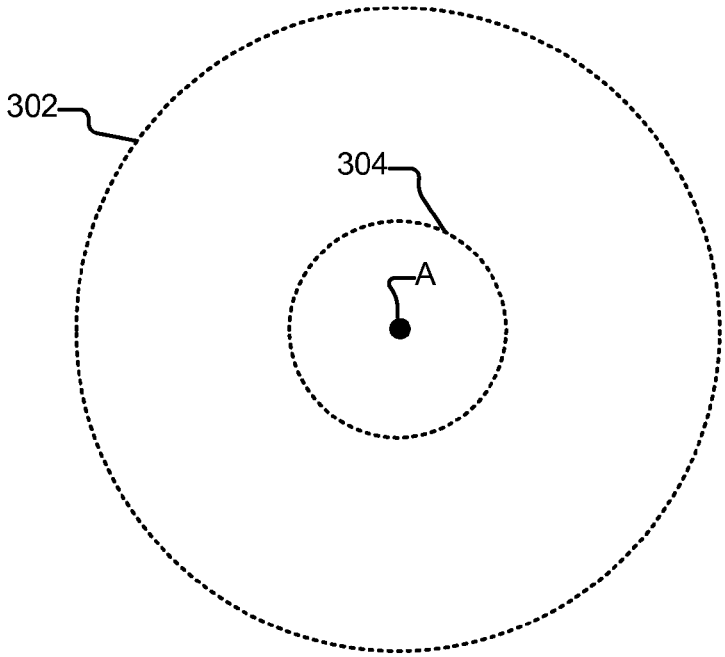

The radiation pattern in which the RF signal 208 radiates from the lens 104 can depend on, among other things, the configuration (e.g., the shape) of the reflector 116 and the face 126 of the lens 104 including the raised portion 108 and the body. In the examples illustrated in the figures in which the face 126 is circular, the raised portion 108 is generally ring shaped (e.g., like a donut), and the surfaces 118 of the reflector 116 are shaped to generally conform to the raised portion 108, the antenna system 100 can radiate the RF signal 208 in a radiation pattern 302 that is generally hemispherical as illustrated in FIGS. 3A and 3B. For example, the shape of the radiation pattern 302 can be hemispherical in a plane 306 that is perpendicular to the axis A of the antenna system 100 and in which the maximum gain of the radiation pattern 302 is one decibel (dB). The radiation pattern 302 can be centered about the axis A and can be omni-directional in the plane 306. As will be discussed with respect to FIGS. 5 and 6, in some applications, the axis A of the antenna system 100 can be oriented to point in the zenith direction or the nadir direction. As used herein, the "zenith direction" is away from the surface of the earth along an axis that is perpendicular to the surface of the earth, and the "nadir direction" is toward the surface of the earth along an axis that is perpendicular to the surface of the earth. Also as used herein, a "horizon plane" is a plane that is perpendicular to the zenith direction or the nadir direction. As will also be illustrated in FIGS. 5 and 6, in some embodiments, the plane 306 can be a horizon plane.

The presence of the reflector 116, among other factors, can cause a null 304 in the radiation pattern 302. As shown, the null 304 can be centered about the reflector 116. In the example shown in FIGS. 3A and 3B, the axis A passes through the center of the reflector 116, and the null 304 is consequently centered generally about the axis A. Due to the efficiency of the antenna system 100, however, the null 304 can be a relatively small percentage of the radiation pattern 302. For example, the depth of the null $D_N$ along the axis A can be less than twenty-five percent of the depth $D_P$ of the radiation pattern 302 along the axis A to the plane 306. In some embodiments, the depth of the null $D_N$ along the axis A can be less than twenty percent of the depth $D_P$ or even less than fifteen percent of the depth $D_P$. The foregoing are examples only, and the depth $D_N$ of the null 304 can be greater than twenty-five percent of the depth $D_P$ of the radiation pattern 302 in some embodiments.

Although the face 126 of the lens 104 is illustrated as circular in the examples shown in the figures, the face 126 can have other shapes. For example, the face 126 of the lens 104 can be square or rectangular or in the shape of other polygons. As another example, the face 126 can be oval. In embodiments in which the face 126 of the lens is other the circular, shapes of the raised portion 108, the depression 110, and/or the reflector 116 can be other than circular and, for example, can correspond generally to the shape of the face 126 of the lens 104. Moreover, the shape of the face 126 and the raised portion 108 and the reflector 116, among other factors, can influence the shape of the radiation pattern 302, which can thus be other than hemispherical.

Figure 4:
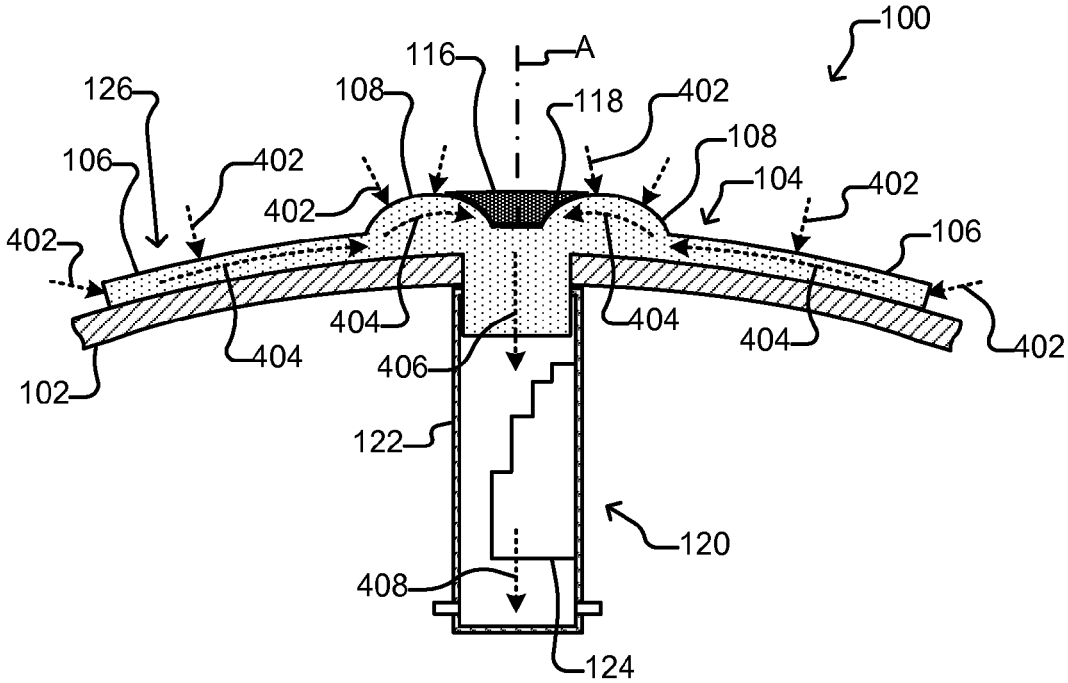
FIG. 4 illustrates an example of the antenna system of FIGS. 1A-1C receiving a radiating RF signal according to some embodiments of the invention.

Returning now to a general discussion of the antenna system 100, the antenna system 100 can also receive RF signals radiating through space (e.g., ambient air). FIG. 4 illustrates an example of operation of the antenna system 100 in which an RF signal is received at the antenna system 100. The operation can be generally the reverse of the operation shown in FIG. 2 in which an RF signal is transmitted from the antenna system 100.

In the example of FIG. 4, an RF signal radiating through space (e.g., ambient air) at a frequency in the resonant frequency range of the lens 104 can resonate in the lens 104. Such an RF signal radiating through space is labeled with reference number 402 in FIG. 4, and that signal resonating in lens 104 is labeled with reference number 404 in FIG. 4. The reflector 116 can reflect the RF signal 404 resonating in the lens 104 down the RF feed path 120. The reflected RF signal is labeled with reference number 406 in FIG. 4. As discussed above, the RF feed path 120 can comprise a waveguide 122, and the reflected RF signal 406 can thus travel through the waveguide 122 away from the reflector 116 as shown in FIG. 4. As noted, the waveguide 122 can include the polarizer 124, which can depolarize the RF signal 406, producing a depolarized RF signal 408. The RF signal 408 can be provided from the RF feed path 120 to an RF receiver (not shown). The coverage pattern of the antenna system 100 for receiving RF signals can be generally the same as the radiating pattern 302 (including null 304) as shown in FIGS. 3A and 3B and discussed above.

The lens 104, as a dielectric resonator, can be configured to transmit and receive RF signals in any of a number of possible frequency ranges. As is known, size dimensions of a dielectric resonator (as noted above, the lens 104 can be a dielectric resonator) are generally proportional to the wavelength ($\lambda_r$) of the resonant frequency divided by the dielectric constant ($\in$) of the dielectric resonator raised to the power one half. That is, dimensions of a dielectric resonator can be proportional to $\lambda_r/\in^{1/2}$, wherein $\lambda_r$ is the wavelength of the resonant frequency of the resonator, $\in$ is the dielectric constant of the resonator, and / represents mathematical division. Thus, for example, dimensions (e.g., the area of a face 126, the diameter $D_L$ of the face 126 if the face is circular, and/or thicknesses $T_B$ and $T_M$ of the lens 104 (see FIGS. 1A-1C) and/or the dielectric constant of the lens 104 can be selected to tune the resonant frequency range of the lens 104 to any of a number of operating frequency ranges. For example, the lens 104—and thus the antenna system 100—can be configured to transmit and receive microwave RF signals. For example, embodiments of the lens 104 can be configured to transmit and receive microwave RF signals in the $K_a$ band (twenty to thirty gigahertz RF signals), the $K_u$ band (twelve to eighteen gigahertz RF signals), the X band (eight to twelve gigahertz RF signals), the C band (four to eight gigahertz RF signals), the S band (two to four gigahertz RF signals), or the L band (one to two gigahertz RF signals). In other embodiments, the lens 104 can be configured to transmit and receive microwave RF signals at frequencies higher than thirty gigahertz or lower than one gigahertz.

In some embodiments of the antenna system 100, the waveguide 122 can be circular and the lens 104 and reflector 116 can be shaped generally as shown in FIGS. 1A-1C, and dimensions of the lens 104, reflector 116, and waveguide 122 can be as follows, where $\lambda_r$ is the wavelength of the resonant frequency of the lens 104: the length $L_W$ of the waveguide 122 can be about 1 to 1.75 times $\lambda_r$; the radius $R_W$ of the waveguide 122 can be about 0.57 to 0.95 times $\lambda_r$; the thickness $T_B$ of the body 106 of the lens 104 can be about 0.53 to 0.9 times $\lambda_r$; the radius of curvature $R_C$ of the body 106 of the lens 104 can be about 3 to 5.14 times $\lambda_r$; the greatest thickness $T_M$ of the raised portion 108 of the lens 104 can be about 1.5 to 2.6 times $\lambda_r$; the thickness $T_R$ of the reflector 116 can be about 0.9 to 1.65 times $\lambda_r$; and the diameter $D_L$ of the face 126 of the lens 104 can be 6.1 to 10.3 times $\lambda_r$. The foregoing ranges are examples only, and the invention is not limited. Thus, in some embodiments of the invention, dimensions of the antenna system 100 can be outside the foregoing ranges.

For some resonant frequencies in the $K_u$ band (twelve to eighteen gigahertz RF signals), the foregoing dimensions in inches can be as follows: the length $L_W$ of the waveguide 122 can be about 0.8 to 1.34 inches; the radius $R_W$ of the waveguide 122 can be about 0.36 to 0.61 inches; the thickness $T_B$ of the body 106 of the lens 104 can be about 0.4 to 0.7 inches; the radius of curvature $R_C$ of the body 106 of the lens 104 can be about 2.3 to 4 inches; the greatest thickness $T_M$ of the raised portion 108 of the lens 104 can be about 1.1 to 2 inches; the thickness $T_R$ of the reflector 116 can be about 0.75 to 1.3 inches; and the diameter $D_L$ of the face 126 of the lens 104 can be 4.7 to 7.9 inches. The foregoing ranges are examples only, and the invention is not limited. Thus, in some embodiments of the invention, dimensions of the antenna system 100 can be outside the foregoing ranges.

There are any number of applications for the antenna system 100 of FIGS. 1A-1C. For example, because the antenna system 100 can conform to the support structure 102 to which it is mounted, the antenna system 100 can be particularly well suited for use on moving vehicles or aircraft.

Figure 5:
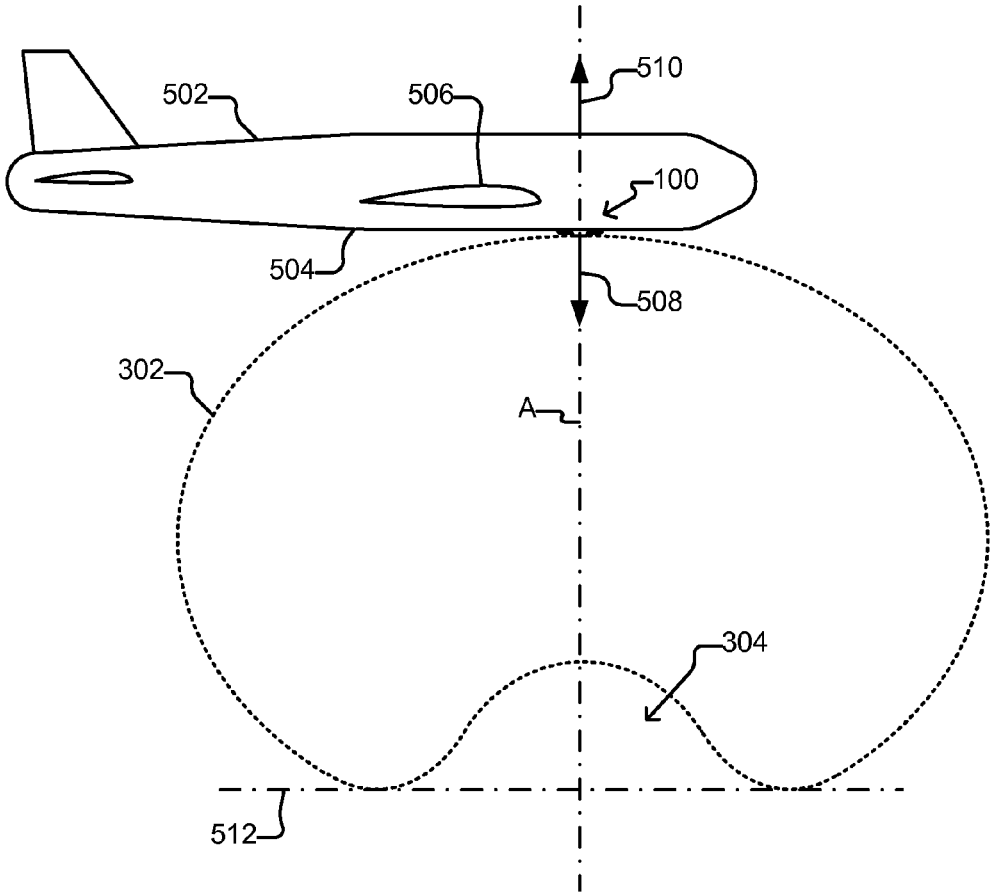
FIG. 5 illustrates an example of the antenna system of FIGS. 1A-1C attached to an aircraft according to some embodiments of the invention.

FIG. 5 illustrates an example in which the antenna system 100 is attached to an aircraft 502. For example, the support structure 102 in FIGS. 1A-1C can be part of the fuselage 504 of the aircraft 502. Alternatively, the support structure 102 can be part of the wing 506 or another part of the aircraft 502. The outer surface of the support structure 102 can thus be an aerodynamic surface of an aircraft in some embodiments. As used herein, "aerodynamic surface" means an outer surface of an aircraft (e.g., an airplane, helicopter, missile, rocket, or the like) or an outer surface of a device attached to an aircraft so as to be outside of the aircraft. An "aerodynamic surface" thus passes through the air as the aircraft is in flight.

As illustrated in FIG. 5, in some embodiments, the antenna system 100 can be oriented on the aircraft 502 such that the axis A coincides with the nadir direction 508 (which as noted above is opposite the zenith direction 510). The radiation pattern 302 of the antenna system 100 can thus be about the nadir direction 508 while the aircraft 502 is in normal flight. As discussed above, the radiation pattern 302 can be hemispherical in a horizon plane 512 in which the gain of the radiation pattern 302 is one decibel (dB) or less and with a shallow null 304 (e.g., having a depth $D_N$ less than twenty-five, less than twenty, or less than fifteen percent of the depth $D_P$ of the radiation pattern 302 to the horizon plane 512 generally as discussed above with respect to FIGS. 3A and 3B (in which the horizon plane 512 is an example of the plane 306). Although illustrated in FIG. 5 as an airplane, the aircraft 502 can alternatively be a helicopter, missile, rocket, or the like. Moreover, antenna system 100 can be oriented on the aircraft 502 such that the axis A is pointed in directions other than the nadir direction 508.

Figure 6:
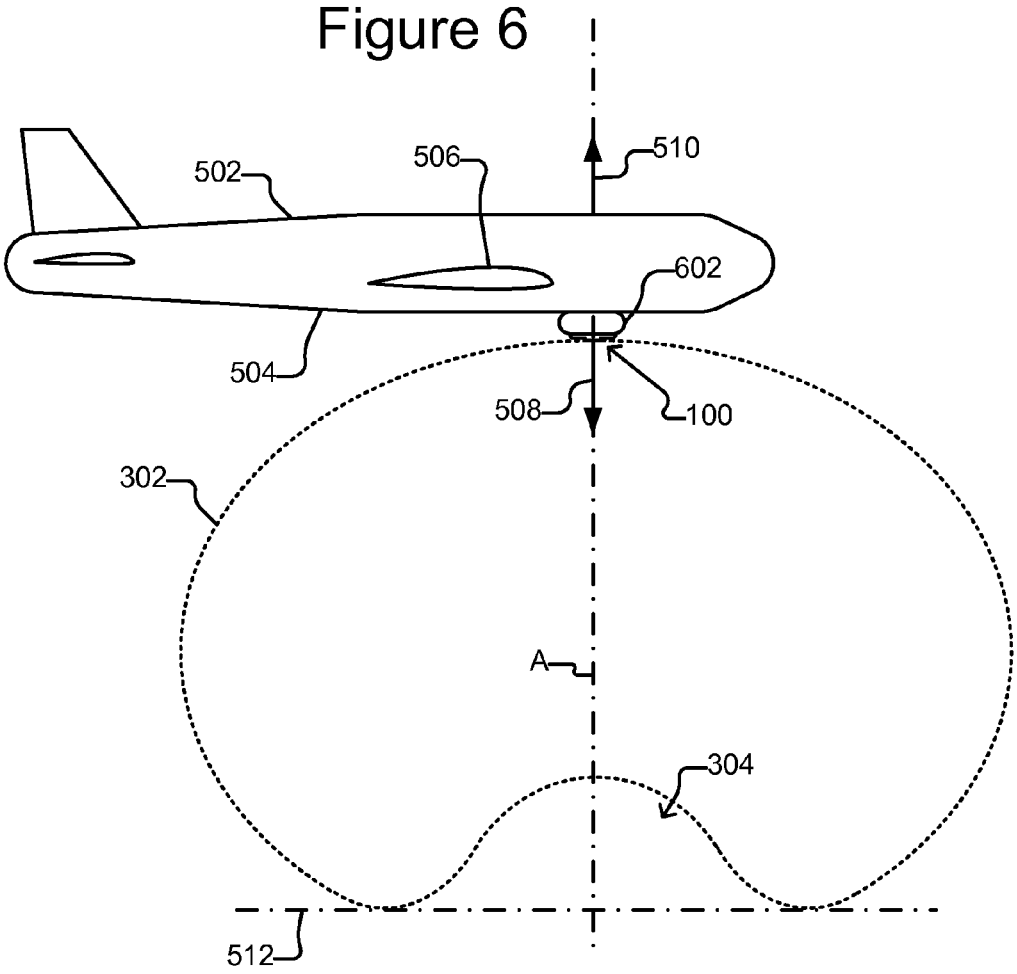
FIG. 6 illustrates an example of the antenna system of FIGS. 1A-1C attached to a pod, which is attached to an aircraft according to some embodiments of the invention.

FIG. 6 illustrates an alternative embodiment in which the antenna system 100 is attached to a pod 602 that is attached to the outside of an aircraft 502 and thus is outside of the aircraft 502. For example, the pod 602 can be attached to the fuselage 504 (as shown) or alternatively a wing 506 or other part of the aircraft 502. In the example illustrated in FIG. 6, the support structure 102 in FIGS. 1A-1C can be part of the pod 602, and the outer surface of the support structure 102 can be an aerodynamic surface of the pod 602. As illustrated in FIG. 6, in some embodiments, the antenna system 100 can be oriented on the pod 602, which can be oriented on the aircraft 502, such that the axis A coincides with the nadir direction 508 during normal flight of the aircraft 502. The radiation pattern 302 can be as discussed above with respect to FIG. 5. Although illustrated in FIG. 6 as an airplane, the aircraft 502 can alternatively be a helicopter, missile, rocket, or the like. Moreover, antenna system 100 can be oriented on the pod 602 (or the pod 602 on the aircraft 502) such that the axis A is pointed in directions other than the nadir direction 508.

Although the invention is not so limited, various embodiments of the conformal antenna system 100 can provide advantages over prior art antenna systems. For example, the antenna system 100 can be configured to protrude only a short distance from the surface of the structure to which the antenna system 100 is attached. For example, configured to transmit and receive RF signals in the $K_u$ band, the antenna system 100 (e.g., the thickness $T_M$ of the raised portion 108 of the lens 104) can extend from the support structure 102 less than three inches, and the antenna system 100 can thus extend from the support structure 102 less than three inches. In other embodiments, however, the thickness $T_M$ can be greater than three inches. Because of its conformal nature and consequent low profile from the support structure, the antenna system 100 can thus be attached to an aircraft without adding appreciable drag to the aircraft. As another example, the antenna system 100 does not yield deep nulls along its axis (axis A in FIGS. 1A-1C). The antenna system 100 can thus be oriented on an aircraft 502 with its axis A oriented such that the radiation pattern 302 is in the nadir 508 direction with maximum gain in the horizon plane 512 and produce only a shallow null 304 (e.g., as discussed above and illustrated in FIGS. 5 and 6). Moreover, the radiation pattern 302 can be shaped as desired (e.g., a hemispherical shape) in the horizon plane 512. As yet another example, the antenna system 100 can transmit and receive relatively high frequency microwave RF signals such as, for example, in the $K_u$ band or higher. As still another example, the antenna system 100 can be lighter weight than prior art antenna systems. Still further examples include ease of constructing the antenna system 100. For example, the lens 104 can be readily formed into a desired shape by machining or molding a dielectric material.

Although specific embodiments and applications of the invention have been described in this specification, these embodiments and applications are exemplary only, and many variations are possible.

We claim:

1. A radio frequency (RF) antenna system comprising:

an RF lens comprising a raised portion and a body extending laterally from said raised portion; and an RF reflector disposed in a depression in said raised portion of said lens, said RF reflector shaped to reflect an RF signal between said body of said lens and an RF feed path to said raised portion of said lens, wherein said RF feed path is generally parallel to an axis through said depression in said raised portion of said lens.

2. The antenna system of claim 1, wherein:

said RF lens comprises a dielectric material, and said reflector comprises an electrically conductive material.

3. The antenna system of claim 2, wherein said lens is a dielectric resonator antenna.

4. The antenna system of claim 2, wherein said body of said lens curves away from a plane passing through said raised portion and perpendicular to said axis as said body extends laterally away from said raised portion.

5. The antenna system of claim 2 further comprising an electrically conductive structure, wherein said body of said lens is attached to a non-planar surface of said electrically conductive structure.

6. The antenna system of claim 5, wherein a shape of said body conforms to said non-planar surface of said conductive structure such that said antenna system extends less than three inches from said surface.

7. The antenna system of claim 6, wherein:

said conductive structure is part of an aircraft, and said non-planar surface of said conductive structure is an aerodynamic surface of said aircraft.

8. The antenna system of claim 6, wherein:

said conductive structure is part of a pod attached to and disposed outside of an aircraft, and said non-planar surface of said conductive structure is an aerodynamic surface of said pod.

9. The antenna system of claim 2 further comprising an RF waveguide disposed with respect to said lens to provide said RF feed path that is generally parallel to said axis through said depression of said lens.

10. The antenna system of claim 9 further comprising an RF polarizer disposed in said RF waveguide to polarize RF signals passing through said RF waveguide to said lens.

11. The antenna system of claim 10, wherein said RF polarizer is a circular polarizer.

12. The antenna system of claim 10, wherein said lens is shaped to radiate an RF signal provided through said waveguide to said raised portion of said lens and reflected by said reflector through said body of said lens in a pattern that is generally hemispherical with a null about said axis.

13. The antenna system of claim 12, wherein a depth of said null is less than twenty percent of a depth of said radiation pattern.

14. The antenna system of claim 2, wherein said raised portion is disposed at a center of said lens.

15. A process of broadcasting from a lens-reflector radio frequency (RF) antenna system, said process comprising:

directing an RF signal in a first direction to a depression in a raised portion of an RF lens;

reflecting with an RF reflector disposed in said depression said RF signal through a body of said lens, said body of said lens extending laterally from said raised portion of said lens; and said RF signal radiating from said body and raised portion of said lens, wherein said first direction is generally parallel to an axis through said depression of said lens.

16. The process of claim 15, wherein:

said RF lens comprises a dielectric material, and said reflector comprises an electrically conductive material.

17. The process of claim 16, wherein said body of said lens curves from a plane passing through said raised portion and perpendicular to said axis as said body extends laterally away from said raised portion.

18. The process of claim 16, wherein said RF signal resonates in said lens.

19. The process of claim 16, wherein:

said body of said lens is attached to a non-planar surface of an electrically conductive structure, and a shape of said body conforms to said non-planar surface of said conductive structure such that said antenna system extends less than three inches from said surface.

20. The process of claim 16, wherein said directing an RF signal comprises directing said RF signal through a waveguide oriented to guide said RF signal in said first direction to said depression in said raised portion of said lens.

21. The process of claim 20, wherein said directing an RF signal further comprises polarizing said RF signal in said waveguide.

22. The process of claim 21, wherein said polarizing comprises circularly polarizing said RF signal.

23. The process of claim 16, wherein:

said directing an RF signal further comprises polarizing said RF signal, and said reflecting comprises reflecting said polarized RF signal.

24. The process of claim 23, wherein said polarizing comprises circularly polarizing said RF signal.

25. The process of claim 16, wherein:

said RF signal radiates from said body and raised portion of said lens in a pattern that is generally hemispherical about said axis with a null about said axis.

26. The process of claim 25, wherein a depth of said null is less than twenty percent of a depth of said radiation pattern.

27. The process of claim 26, wherein said pattern has a maximum gain of one decibel in a plane that is perpendicular to said axis.

28. The process of claim 27, wherein:

a nadir direction is along said axis, and said plane is a horizon plane.

* * * * *